US011441744B2

(12) United States Patent
Bai et al.

(10) Patent No.: US 11,441,744 B2
(45) Date of Patent: Sep. 13, 2022

(54) ELONGATED FRAME LAMP

(71) Applicant: NINGBO JINGHUI OPTO-ELECTRONIC CO., LTD., Zhejiang Province (CN)

(72) Inventors: Guohui Bai, Zhejiang Province (CN); Guohuan Feng, Zhejiang Province (CN)

(73) Assignee: NINGBO JINGHUI OPTO-ELECTRONIC CO., LTD., Zhejiang Province (CN)

( * ) Notice: Subject to any disclaimer, the term of this patent is extended or adjusted under 35 U.S.C. 154(b) by 0 days.

(21) Appl. No.: 17/350,112

(22) Filed: Jun. 17, 2021

(65) Prior Publication Data

US 2021/0310624 A1 Oct. 7, 2021

Related U.S. Application Data

(63) Continuation-in-part of application No. 16/682,707, filed on Nov. 13, 2019, now abandoned.

(51) Int. Cl.

| | |
|---|---|
| ***F21S 4/28*** | (2016.01) |
| ***F21V 23/02*** | (2006.01) |
| ***F21V 21/008*** | (2006.01) |
| ***F21V 23/06*** | (2006.01) |

(52) U.S. Cl.

CPC ..... *F21S 4/28* (2016.01); *F21V 21/008* (2013.01); *F21V 23/02* (2013.01); *F21V 23/06* (2013.01)

(58) Field of Classification Search

CPC . F21K 9/27; F21K 9/272; F21K 9/275; F21K 9/278

See application file for complete search history.

(56) References Cited

U.S. PATENT DOCUMENTS

| | | | | |
|---|---|---|---|---|
| 2010/0277914 | A1 | 11/2010 | Bachl | |
| 2011/0006702 | A1 | 1/2011 | Wu | |
| 2012/0075850 | A1 | 3/2012 | Chang | |
| 2013/0234622 | A1 | 9/2013 | Tanaka | |
| 2014/0268727 | A1* | 9/2014 | Amrine, Jr. ..... | F21K 9/27 362/224 |
| 2015/0155459 | A1 | 6/2015 | Ishihara | |
| 2015/0345712 | A1* | 12/2015 | Purdy ..... | F21K 9/60 362/223 |
| 2016/0069522 | A1 | 3/2016 | Rao | |
| 2016/0302275 | A1 | 10/2016 | Newton | |
| 2017/0102113 | A1 | 4/2017 | Wu | |

* cited by examiner

*Primary Examiner* — Andrew J Coughlin

(74) *Attorney, Agent, or Firm* — Charles C. Achkar; Ostrolenk Faber LLP.

(57) ABSTRACT

The present invention discloses an elongated frame lamp, comprising a lamp body, a lamp board and a lampshade; the lamp body has a first plug on one end and a second plug on the other end; the lamp board is placed between the lamp body and the lampshade; wherein the lamp board and lamp body are separated through an insulation tape; a heat-conducting dual side insulation tape resistant to high voltages up to 4000V is used to securely fasten the light strip into an elongated aluminum housing groove. As a core part, the heat-conducting dual side insulation tape resistant to high voltages can fully achieve a safe creepage distance in ETL accreditation.

10 Claims, 7 Drawing Sheets

ELONGATED FRAME LAMP

CROSS REFERENCE TO RELATED APPLICATIONS

The present application is a continuation-in-part of U.S. application Ser. No. 16/682,707 filed on Nov. 13, 2019 which is incorporated herein by reference in its entirety.

TECHNICAL FIELD

The present invention relates to the LED frame lamp technical field and in particular, relates to an elongated frame lamp.

BACKGROUND OF INVENTION

An LED frame lamp mainly comprises an "upper lamp head structure" and a "bottom lamp tube structure." Such an existing frame lamp has the following defects:

1. If an isolated power supply is used, the purpose of having a narrower LED lamp board strip can be achieved, but the cost of such an isolated power supply is high.

2. If a non-isolated power supply is used, the width of the LED lamp board strip must be increased to meet the requirements for a safe creepage distance in ETL accreditation. An increase in the width of the lamp board is structurally not permissible.

CONTENTS OF INVENTION

(I) Technical Issues to be Resolved

The purpose of the present invention is to overcome the weaknesses by providing an elongated frame lamp.

(II) Technical Solution

To achieve the purpose, the elongated frame lamp in the present invention comprises a lamp body, a lamp board and a lampshade; the lamp body has a first plug on one end and a second plug on the other end; the lamp board is disposed between the lamp body and the lampshade; wherein the lamp board and lamp body are separated through an insulation tape; the outer side of the first plug has a pull switch. The upper end of the first plug has a power plug end.

Further, a pair of hook screws are symmetrically disposed on the upper part of the lamp body. The upper part of the hook screws is connected to an S-shaped hanging hook.

Further, the installation side of the lamp body and the lamp board is an inwards recessed groove; the backside of the insulation tape is bonded to the groove and the front side is bonded to the lamp board.

Further, at least a pair of slide ways are disposed on the two sides of groove. There are insertion lampshade parts on the two sides of the lampshade. Such insertion parts are inserted along such slide ways.

Further, a drive assembly is installed in the lamp body. An AC-DC constant current circuit is built the drive assembly.

Further, the insulation tape includes a bonding portion and extending portions formed by outwards extending from two sides of the bonding portion, and the lamp board is bonded to the side of the bonding portion facing the lampshade.

Further, the extending portions and the bonding portion are disposed at an angle, and the extending portions bend towards the side of the bonding portion bonded to the lamp board.

Further, the extending portions include a first extending portion connected with the bonding portion at one end and disposed at an angle to the bonding portion, and a second extending portion formed by outwards bending the other end of the first extending portion, and the second extending portion is parallel to the bonding portion.

Further, the installation side of the lamp body and the lamp board is an inwards recessed groove, the groove is provided with a bottom surface and extending surfaces extending from the bottom surface to two sides, the insulation tape covers the bottom surface and the extending surfaces, the insulation tape covering the bottom surface forms the bonding portion, and the insulation tape covering the bottom surface forms the extending portions.

Further, an angle between the extending portions and the bonding portion is $\alpha$, and $\alpha$ is 113°.

Further, the lamp body is provided with a first cavity configured to accommodate the drive assembly.

The first plug includes a first lamp body cover plate sealing and covering one side of the first cavity, and a first plug flange disposed at the side of the first lamp body cover plate facing the first cavity and extending towards the inside of the first cavity, a first resilience clip is disposed on the first plug flange, and the first cavity is provided with a first clip hole matched with the first resilience clip.

The first lamp body cover plate extends towards the lampshade so as to form a first lampshade cover plate configured to seal and cover one side of the lampshade, the side of the first lampshade cover plate facing the lampshade protrudes to form a first limiting flange, the first limiting flange and the first lampshade cover plate form a first limiting cavity, and one end of the lampshade is placed in the first limiting cavity.

The second plug includes a second lamp body cover plate sealing and covering the other side of the first cavity, and a second plug flange disposed at the side of the second lamp body cover plate facing the first cavity and extending towards the inside of the first cavity, a second resilience clip is disposed on the second plug flange, and the first cavity is provided with a second clip hole matched with the second resilience clip.

The second lamp body cover plate extends towards the lampshade so as to form a second lampshade cover plate configured to seal and cover the other side of the lampshade, the side of the second lampshade cover plate facing the lampshade protrudes to form a second limiting flange, the second limiting flange and the second lampshade cover plate form a second limiting cavity, and the other end of the lampshade is placed in the second limiting cavity.

(III) Beneficial Effects

Compared with the existing art, the technical solution of the present invention has the following advantages: The elongated frame lamp in the present application is a non-isolated power supply as well as a lamp with a narrower LED lamp board strip. A heat-conducting dual side insulation tape resistant to a high voltage of up to 4000V is used to securely fasten the lamp strip into an elongated aluminum housing groove. As a core part, the heat-conducting dual side insulation tape resistant to high voltages can fully achieve a safe creepage distance in ETL accreditation.

EMBODIMENTS

In combination with the attached drawings and embodiments, the following is a further and detailed description of the specific embodiments of the present invention. The following embodiment is used to describe the present invention, but should not be used to limit the scope of the present invention.

Figure 1:
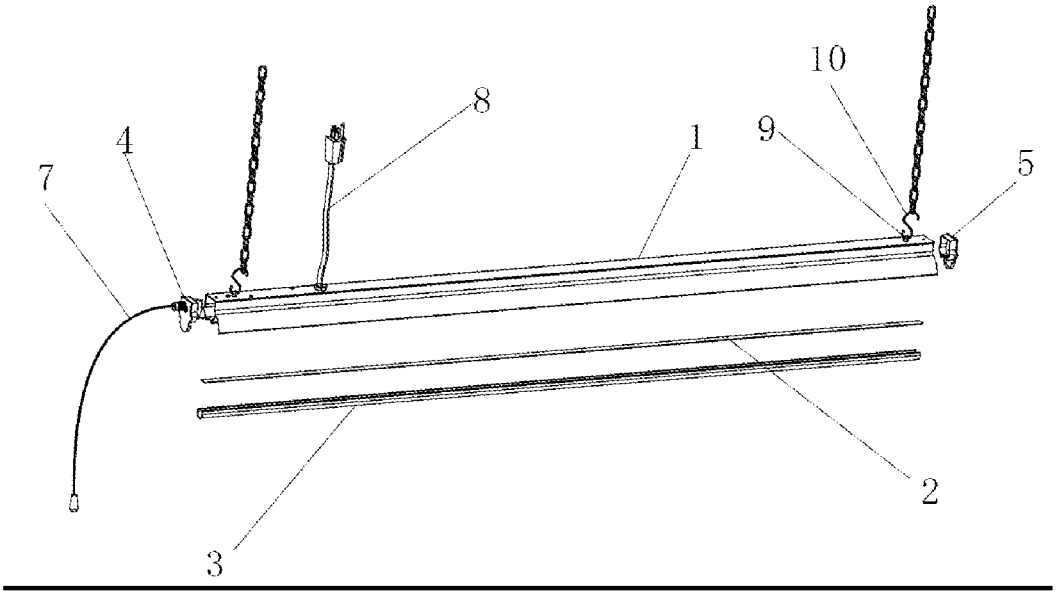
FIG. 1 is an explosive view of an elongated frame lamp in the present invention.
Figure 2:
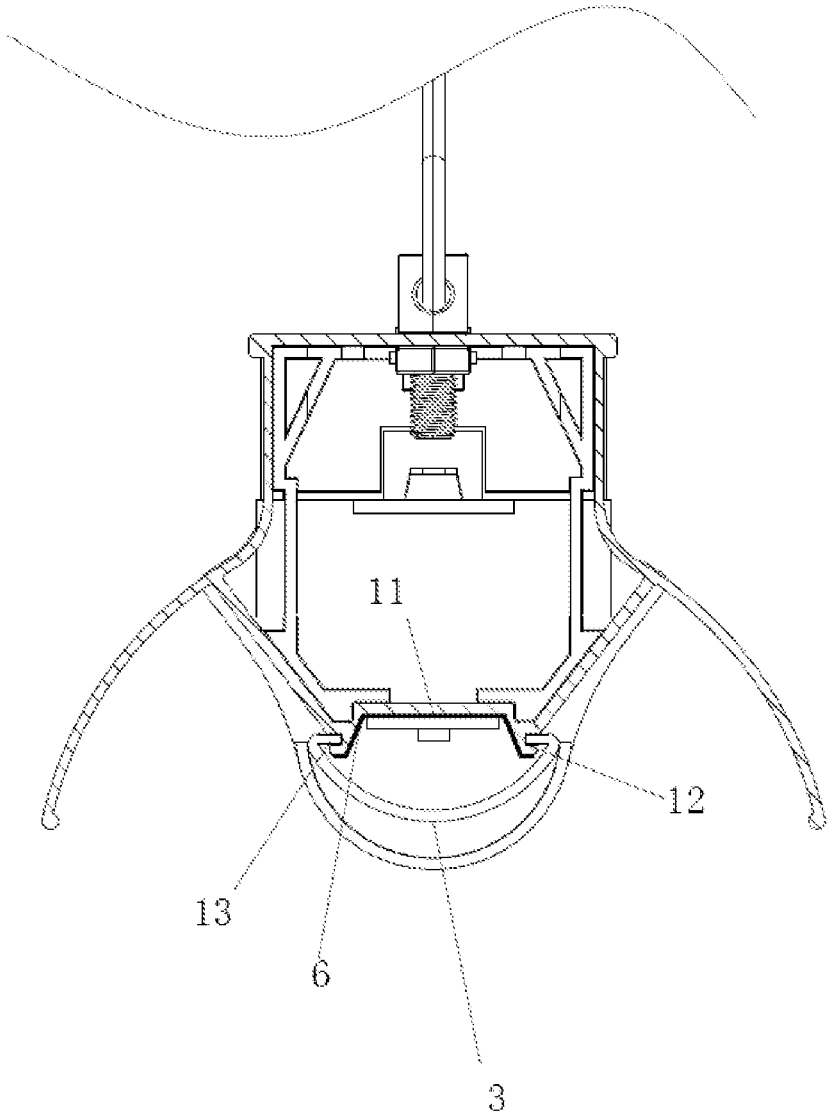
FIG. 2 is a structural diagram of the cross-section of the elongated frame lamp in the present new invention.

As illustrated in FIG. 1 and FIG. 2, the elongated frame lamp in the present invention comprises lamp body 1, lamp board 2 and lampshade 3; the lamp body 1 has a first plug 4 on one end and a second plug 5 on the other end. Plugs are common designs for a frame lamp; the lamp board 2 is disposed between lamp body 1 and lampshade 3; wherein the lamp board 2 and lamp body 1 are separated through an insulation tape 6; the outer side of the first plug 4 has a pull switch 7. The upper end of the first plug 4 has a power plug end 8 to supply power for the frame lamp.

A pair of hook screws 9 are symmetrically disposed on the upper part of the lamp body 1. The upper parts of the hook screws 9 are connected to an S-shaped hanging hook 10, used to hang the entire frame lamp.

The installation side of the lamp body 1 and lamp board 2 is a groove 11 with a concave; the backside of the insulation tape 6 is bonded to groove 11 and the front side is bonded to lamp board 2. In the present embodiment, groove 11 has extended surfaces and a bottom surface on the two sides. Insulation tape 6 happens to cover the extended services in the bottom surface. Lamp board 2 is affixed on the bottom surface of groove 11.

At least a pair of slide ways 12 are disposed on the two sides of groove 11. There are insertion lampshade parts 13 shaped like hooks on the two sides of the lampshade 3. Such insertion parts 13 are inserted along such slide ways 12.

A drive assembly (not shown in the Figures) is installed in lamp body 1. An AC-DC constant current circuit is built in the drive assembly. Constant current circuits are common power supply methods in the frame lamp field and we will not elaborate on them here.

Figure 3:
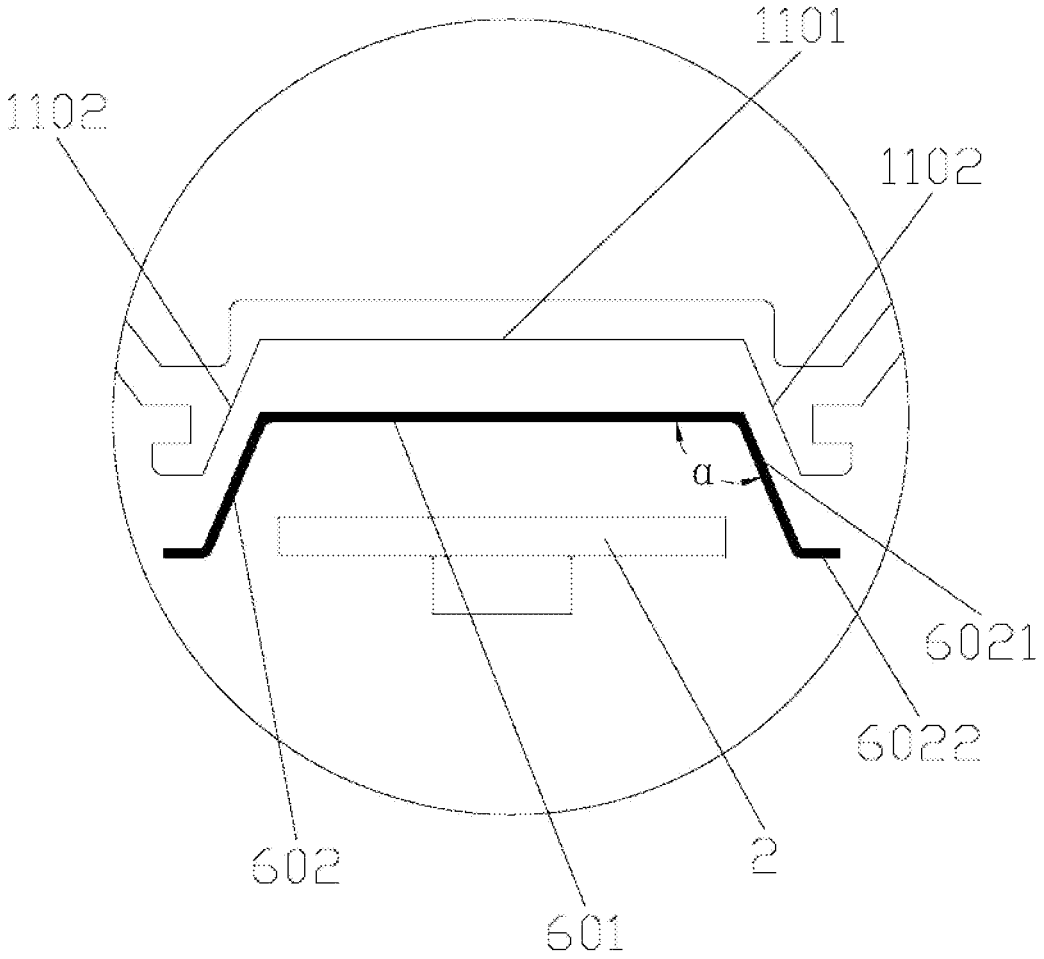
FIG. 3 is a schematic diagram of installation and cooperation of a lamp body, a lamp board and an insulation tape of the elongated frame lamp in the present invention.
Figure 4:
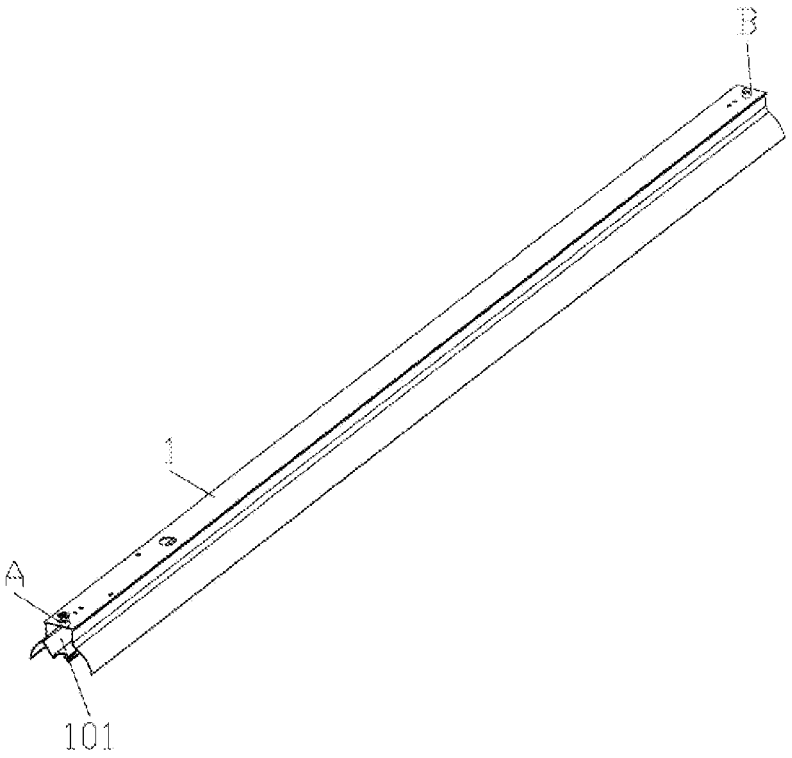
FIG. 4 is a schematic structural diagram of the lamp body of the elongated frame lamp in the present invention.
Figure 5:
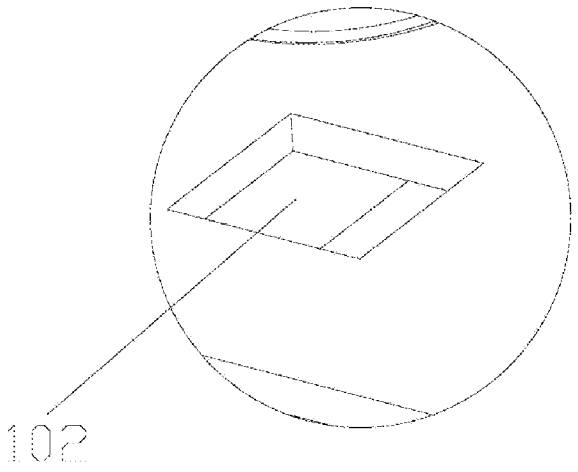
FIG. 5 is an enlarged diagram of a part A in FIG. 4.
Figure 6:
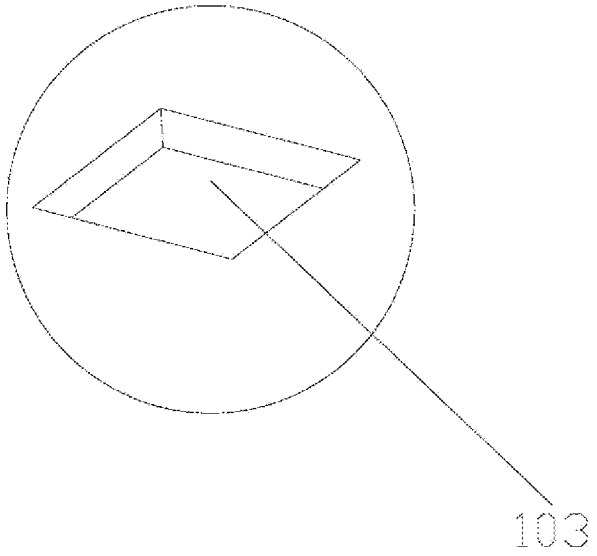
FIG. 6 is an enlarged diagram of a part B in FIG. 4.
Figure 7:
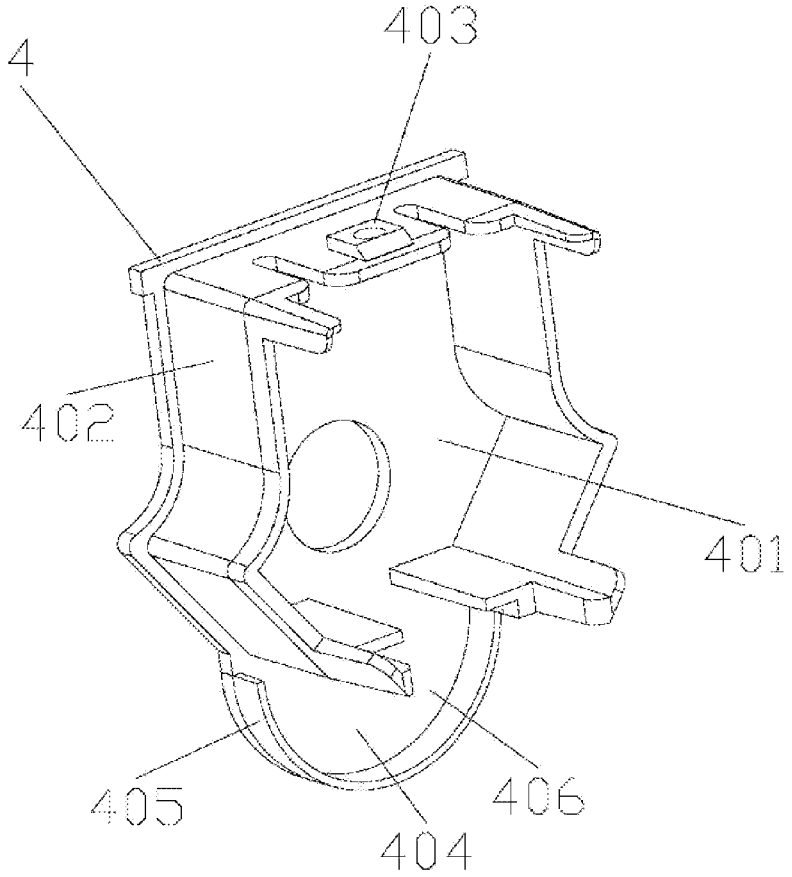
FIG. 7 is a schematic structural diagram of a first plug of the elongated frame lamp in the present invention.
Figure 8:
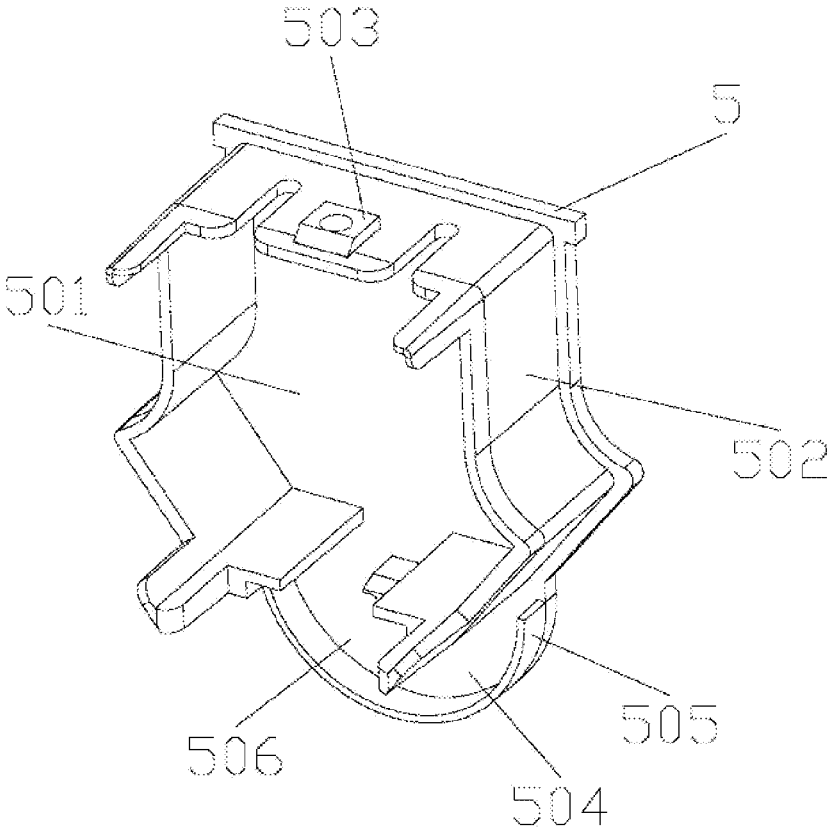
FIG. 8 is a schematic structural diagram of a second plug of the elongated frame lamp in the present invention.

As shown in FIG. 3, the insulation tape 6 includes a bonding portion 601 and extending portions 602 formed by outwards extending from two sides of the bonding portion 601, and the lamp board 2 is bonded to the side of the bonding portion 601 facing the lampshade 3.

By adopting the structure, through the arrangement of the extending portions 602, the creepage distance can be increased, so that the elongated frame lamp conforms to the requirement of a safe creepage distance in ETL accreditation when using a non-insulation power supply.

The extending portions 602 and the bonding portion 601 are disposed at an angle, and the extending portions 602 bend towards the side of the bonding portion 601 bonded to the lamp board 2.

By adopting the structure, the extending portions 602 and the bonding portion 601 are disposed at an angle, so that the creepage distance is increased by the elongated frame lamp, and at the same time, the width of the elongated frame lamp does not need to be increased, or only needs to be increased slightly.

The extending portions 602 include a first extending portion 6021 connected with the bonding portion 601 at one end and disposed at an angle to the bonding portion 601, and a second extending portion 6022 formed by outwards bending the other end of the first extending portion 6021, and the second extending portion 6022 is parallel to the bonding portion 601.

The installation side of the lamp body 1 and the lamp board 2 is an inwards recessed groove 11, the groove 11 is provided with a bottom surface 1101 and extending surfaces 1102 extending from the bottom surface 1101 to two sides, an insulation tape 6 covers the bottom surface 1101 and the extending surfaces 1102, the insulation tape 6 covering the bottom surface 1101 forms the bonding portion 601, and the insulation tape 6 covering the bottom surface 1101 forms the extending portions 602.

An angle between the extending portions 602 and the bonding portion 601 is $\alpha$, and $\alpha$ is 113°.

As shown in FIG. 4 to FIG. 8, the lamp body 1 is provided with a first cavity configured to accommodate the drive assembly.

The first plug 4 includes a first lamp body cover plate 401 sealing and covering one side of the first cavity, and a first plug flange 402 disposed at the side of the first lamp body cover plate 401 facing the first cavity and extending towards the inside of the first cavity, a first resilience clip 403 is disposed on the first plug flange 402, and the first cavity is provided with a first clip hole 102 matched with the first resilience clip 403.

The first lamp body cover plate 401 extends towards the lampshade 3 side so as to form a first lampshade cover plate 404 configured to seal and cover one side of the lampshade 3, the side of the first lampshade cover plate 404 facing the lampshade 3 protrudes to form a first limiting flange 405, the first limiting flange 405 and the first lampshade cover plate 404 form a first limiting cavity 406, and one end of the lampshade 3 is placed in the first limiting cavity 406.

The second plug 5 includes a second lamp body cover plate 501 sealing and covering the other side of the first cavity, and a second plug flange 502 disposed at the side of the second lamp body cover plate 501 facing the first cavity and extending towards the inside of the first cavity, a second resilience clip 503 is disposed on the second plug flange 502, and the first cavity is provided with a second clip hole 103 matched with the second resilience clip 503.

The second lamp body cover plate 501 extends towards the lampshade 3 so as to form a second lampshade cover plate 504 configured to seal and cover the other side of the lampshade 3, the side of the second lampshade cover plate 504 facing the lampshade 3 protrudes to form a second limiting flange 505, the second limiting flange 505 and the second lampshade cover plate 504 form a second limiting cavity 506, and the other end of the lampshade 3 is placed in the second limiting cavity 506.

By using the above structure surface, the first plug 4 and the second plug 5 can be more conveniently installed onto the lamp body 1. Specifically, the first clip hole 102 and the second clip hole 103 are formed in the top surface of the first accommodating cavity 101, correspondingly, the first resilience clip 403 is disposed on the side of the first plug flange 402 facing the top surface of the first accommodating cavity 101, and the second resilience clip 503 is disposed on the side of the second plug flange 502 facing the top surface of the first accommodating cavity 101.

Insulation tape 6 in the present application is a dual side insulation tape 6 and is characterized in that it conducts heat and is resistant to high voltages up to 4000V.

The elongated frame lamp in the present application is a non-isolated power supply as well as a lamp with a narrower LED lamp board strip. It uses a heat-conducting dual side insulation tape that is resistant to high voltage of up to 4000V to securely fasten the lamp strip into an elongated aluminum housing groove. As a core part, the heat-conducting dual side insulation tape resistant to high voltages can fully achieve a safe creepage distance in ETL accreditation.

In summary, the embodiment is not a restrictive embodiment of the present new invention. All modifications or equivalent variations made by those skilled in the art based on the substantive contents of the present invention will be within the technical scope of the present invention.

What is claimed is:

1. An elongated frame lamp, comprising a lamp body, a lamp board and a lampshade, wherein the lamp body has a first plug on one end and a second plug on the other end; the lamp board is disposed between the lamp body and the lampshade; the lamp board and lamp body are separated through an insulation tape; the outer side of the first plug has a pull switch; and the upper end of the first plug has a power plug end; wherein the insulation tape comprises a bonding portion and extending portions formed by outwards extending from two sides of the bonding portion, and the lamp board is bonded to the side of the bonding portion facing the lampshade; and the extending portions and the bonding portion are disposed at an angle, and the extending portions bend towards the side of the bonding portion bonded to the lamp board.

2. The elongated frame lamp according to claim 1, wherein a pair of hook screws are symmetrically disposed on the upper part of the lamp body, and the upper parts of the hook screws are connected to an S-shaped hanging hook.

3. The elongated frame lamp according to claim 2, wherein the installation side of the lamp body and the lamp board is an inwards recessed groove; and the backside of the insulation tape is bonded to the groove and the front side is bonded to the lamp board.

4. The elongated frame lamp according to claim 3, wherein at least a pair of slide ways are disposed on the two sides of groove, there are insertion lampshade parts on the two sides of the lampshade, and the insertion parts are inserted along the slide ways.

5. The elongated frame lamp according to claim 4, wherein a drive assembly is installed in the lamp body, and an AC-DC constant current circuit is built in the drive assembly.

6. The elongated frame lamp according to claim 5, wherein the lamp body is provided with a first cavity configured to accommodate the drive assembly;

the first plug comprises a first lamp body cover plate sealing and covering one side of the first cavity, and a first plug flange disposed at one side of the first lamp body cover plate facing the first cavity and extending towards the inside of the first cavity, a first resilience clip is disposed on the first plug flange, and the first cavity is provided with a first clip hole matched with the first resilience clip;

the first lamp body cover plate extends towards the lampshade so as to form a first lampshade cover plate configured to seal and cover one side of the lampshade, the side of the first lampshade cover plate facing the lampshade protrudes to form a first limiting flange, the first limiting flange and the first lampshade cover plate form a first limiting cavity, and one end of the lampshade is placed in the first limiting cavity;

the second plug comprises a second lamp body cover plate sealing and covering the other side of the first cavity, and a second plug flange disposed at the side of the second lamp body cover plate facing the first cavity and extending towards the inside of the first cavity, a second resilience clip is disposed on the second plug flange, and the first cavity is provided with a second clip hole matched with the second resilience clip; and the second lamp body cover plate extends towards the lampshade so as to form a second lampshade cover plate configured to seal and cover the other side of the lampshade, the side of the second lampshade cover plate facing the lampshade protrudes to form a second limiting flange, the second limiting flange and the second lampshade cover plate form a second limiting cavity, and the other end of the lampshade is placed in the second limiting cavity.

7. The elongated frame lamp according to claim 1, wherein the extending portions comprise a first extending portion connected with the bonding portion at one end and disposed at an angle to the bonding portion, and a second extending portion formed by outwards bending the other end of the first extending portion, and the second extending portion is parallel to the bonding portion.

8. The elongated frame lamp according to claim 1, wherein the installation side of the lamp body and the lamp board is an inwards recessed groove, the groove is provided with a bottom surface and extending surfaces extending from the bottom surface to two sides, the insulation tape covers the bottom surface and the extending surfaces, the insulation tape covering the bottom surface forms the bonding portion, and the insulation tape covering the bottom surface forms the extending portions.

9. The elongated frame lamp according to claim 1, wherein an angle between the extending portions and the bonding portion is a, and a is greater than 90° but smaller than 180°.

10. The elongated frame lamp according to claim 1, wherein an angle between the extending portions and the bonding portion is a, and a is 113°.

* * * * *